US008511260B2

(12) United States Patent
Kardos et al.

(10) Patent No.: US 8,511,260 B2
(45) Date of Patent: Aug. 20, 2013

(54) APPARATUS FOR PREVENTING ICING IN A SUPERCHARGED INTERNAL COMBUSTION ENGINE

(75) Inventors: Zoltan Kardos, Södertälje (SE); Erik Söderberg, Stockholm (SE)

(73) Assignee: Scania CV AB (SE)

( * ) Notice: Subject to any disclaimer, the term of this patent is extended or adjusted under 35 U.S.C. 154(b) by 434 days.

(21) Appl. No.: 12/920,719

(22) PCT Filed: Feb. 17, 2009

(86) PCT No.: PCT/SE2009/050169

§ 371 (c)(1),
(2), (4) Date: Sep. 2, 2010

(87) PCT Pub. No.: WO2009/110840

PCT Pub. Date: Sep. 11, 2009

(65) Prior Publication Data

US 2011/0000446 A1 Jan. 6, 2011

(30) Foreign Application Priority Data

Mar. 6, 2008 (SE) ..... 0800529

(51) Int. Cl.
*F02B 33/00* (2006.01)

(52) U.S. Cl.
USPC ..... 123/41.33; 123/41.29; 123/543; 123/563

(58) Field of Classification Search
USPC ..... 123/41.01, 41.29, 41.31, 41.08, 563, 123/543, 556
See application file for complete search history.

(56) References Cited

U.S. PATENT DOCUMENTS 5,598,705 A 2/1997 Uzkan
6,230,668 B1 5/2001 Marsh et al.

FOREIGN PATENT DOCUMENTS

GB 950020 A 2/1964
WO WO 2007/108761 A1 9/2007

OTHER PUBLICATIONS

International Search Report dated Jun. 15, 2009, issued in corresponding international application No. PCT/SE2009/050169.

*Primary Examiner* — Noah Kamen
(74) *Attorney, Agent, or Firm* — Ostrolenk Faber LLP

(57) ABSTRACT

An arrangement for a supercharged combustion engine for preventing ice formation in a cooler. A first cooling system with a circulating coolant. A second cooling system with a circulating coolant which during normal operation of the combustion engine is at a lower temperature than the coolant in the first cooling system. The cooler in which a gaseous medium for the engine and which contains water vapor is intended to be cooled by the coolant in the second cooling system. A heat exchanger. A valve which can be placed in a first position wherein coolant from at least one of the cooling systems is prevented from flowing through the heat exchanger and in a second position wherein coolant from both of the cooling systems flows through the heat exchanger so that the coolant in the second cooling system is warmed by the coolant in the first cooling system.

12 Claims, 1 Drawing Sheet

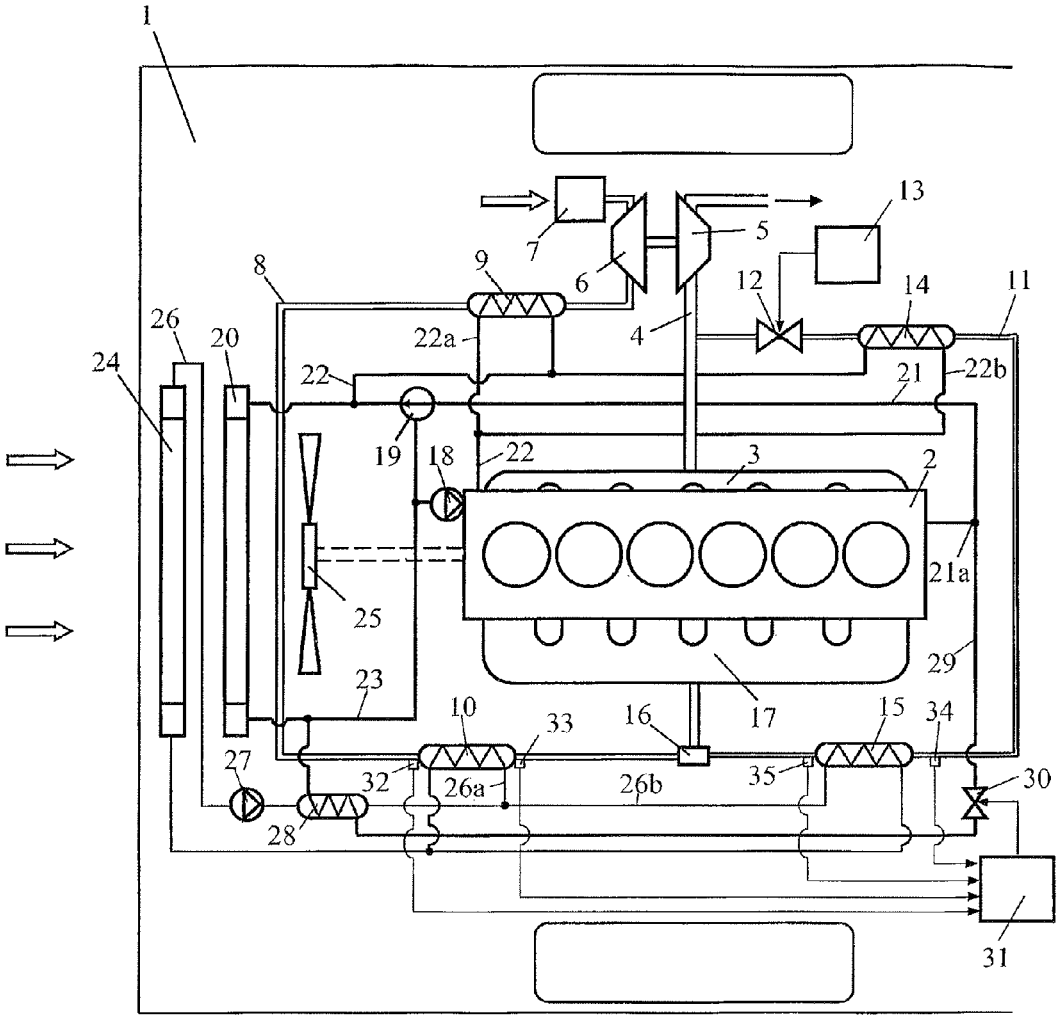
1
7
6
5
13
8
9
12
14
11
26
20
22a
4
24
22
21
22b
19
18
22
3
2
21a
25
29
23
10
33
16
17
15
34
27
32
26a
26b
35
30
28
31

APPARATUS FOR PREVENTING ICING IN A SUPERCHARGED INTERNAL COMBUSTION ENGINE

CROSS-REFERENCE TO RELATED APPLICATIONS

The present application is a 35 U.S.C. §§371 national phase conversion of PCT/SE2009/050169, filed Sep. 11, 2009, which claims priority of Swedish Application No. 0800529-0, filed Mar. 6, 2008, the contents of which are incorporated by reference herein. The PCT International Application was published in the English language.

BACKGROUND TO THE INVENTION, AND STATE OF THE ART

The present invention relates to an arrangement for a supercharged combustion engine having two cooperating cooling systems.

The amount of air which can be supplied to a supercharged combustion engine depends on the pressure of the air and also on the temperature of the air. Supplying the largest possible amount of air to the combustion engine entails effective cooling of the air before it is led to the combustion engine. The air is usually cooled in a charge air cooler arranged at a front portion of a vehicle. At that location the charge air cooler has a cooling air flow at the temperature of the surroundings flowing through it, which makes it possible for the compressed air to be cooled to a temperature close to the temperature of the surroundings. In cold weather conditions, the compressed air may be cooled to a temperature below the dewpoint temperature of the air, resulting in precipitation of water vapour in liquid form in the charge air cooler. When the temperature of the surrounding air is lower than 0° C., there is also risk of the precipitated water freezing to ice within the charge air cooler. Such ice formation will cause a greater or lesser amount of obstruction of the airflow ducts within the charge air cooler, resulting in a reduced flow of air to the combustion engine and consequent operational malfunctions or stoppages.

The technique known as EGR (Exhaust Gas Recirculation) is a known way of recirculating part of the exhaust gases from a combustion process in a combustion engine. The recirculating exhaust gases are mixed with the inlet air to the combustion engine before the mixture is led to the cylinders of the combustion engine. Adding exhaust gases to the air causes a lower combustion temperature, resulting inter alia in a reduced content of nitrogen oxides $NO_x$ in the exhaust gases. This technique is used both for Otto engines and for diesel engines. Supplying a large amount of exhaust gases to the combustion engine entails effective cooling of the exhaust gases before they are led to the combustion engine. The exhaust gases may be subjected to a first step of cooling in an EGR cooler which is cooled by coolant from the combustion engine's cooling system, and a second step of cooling in an air-cooled EGR cooler. The exhaust gases can thus also be cooled to a temperature close to the temperature of the surroundings. Exhaust gases contain water vapour which condenses within the EGR cooler when the exhaust gases undergo the second step of cooling to a temperature which is lower than the dewpoint of the water vapour. When the temperature of the temperature of the surroundings is below 0° C., there is also risk of the condensate formed freezing to ice within the second EGR cooler. Such ice formation will cause a greater or lesser amount of obstruction of the exhaust gas flow ducts within the EGR cooler. When the recirculation of exhaust gases ceases or is considerably reduced, the result is an increased content of nitrogen oxides in the exhaust gases.

SUMMARY OF THE INVENTION

The object of the present invention is to provide an arrangement whereby a gaseous medium which contains water vapour can be subjected to very good cooling in a cooler while at the same time the risk of the cooler being obstructed is avoided.

This object is achieved with the arrangement of the kind mentioned in the introduction and according to the invention. For the gaseous medium to be effectively cooled, it needs to be cooled by a coolant in a cooling system which may be referred to as a low-temperature cooling system. When coolant in a low-temperature cooling system is used, the arrangement is usually cooled to a temperature at which water in liquid form is precipitated within the cooler. If the coolant is also colder than 0° C., there is obvious risk of the water freezing to ice within the cooler. The lower the temperature of the coolant in the low-temperature cooling system, the greater this risk. The arrangement also comprises a cooling system with a warmer coolant than the coolant in the low-temperature cooling system. This cooling system may be referred to as a high-temperature cooling system. According to the invention, a heat exchanger and a valve apparatus are used to make it possible to warm the coolant in the low-temperature cooling system by means of the warmer coolant in the high-temperature cooling system. During normal operation of the combustion engine, the valve apparatus is placed in a first position whereby coolant from at least one of the cooling systems is prevented from flowing through the heat exchanger. The result is no heat transfer between the coolants in the two cooling systems. When the valve apparatus is placed in a second position, however, coolant from both of the cooling systems is allowed to flow through the heat exchanger. In this case the coolant in the low-temperature cooling system is warmed in the heat exchanger by the warmer coolant in the high-temperature cooling system. Such warming is favourable in situations where the coolant in the low-temperature cooling system is at such a low temperature that it risks cooling the gaseous medium so much that ice will form within the cooler. If a person decides that the cooler risks freezing up or is about to freeze up, the valve apparatus can be placed manually in the second position. When the risk of ice formation ceases, the valve apparatus can be returned to the first position. The gaseous medium can thus be provided with very good cooling in a cooler while at the same time ice formation in the cooler can be avoided.

The invention relates to an arrangement for a supercharged combustion engine for preventing ice formation in a cooler. The arrangement comprises a first cooling system with a first circulating coolant and a second cooling system with a second circulating coolant which during normal operation of the combustion engine is at a lower temperature than the first coolant in the first cooling system. The cooler in which a gaseous medium which contains water vapour is intended to be cooled by the coolant in the second cooling system. A heat exchanger establishes temperature of coolant to the cooler. A valve which can be placed in a first position wherein coolant from at least one of the cooling systems is prevented from flowing through the heat exchanger and in a second position wherein coolant from both of the cooling systems flows through the heat exchanger so that the coolant in the second cooling system is warmed by the coolant in the first cooling system.

According to a preferred embodiment of the invention, the arrangement comprises at least one sensor adapted to detecting a parameter which indicates whether the gaseous medium is cooled so much that there is ice formation or risk of ice formation in the cooler, and a control unit adapted to receiving information from said component(s) and to deciding whether there is ice formation or risk of ice formation in the cooler and, if so, to placing the valve apparatus in the second position. With such a configuration, the valve apparatus can be automatically placed in the second position when there is risk of ice formation in the cooler. The control unit may be a computer unit with suitable software for the purpose. The sensor may be a temperature sensor which detects the temperature of the coolant in the low-temperature cooling system. If the temperature of the coolant is over 0° C. when it is led into the cooler, there is no risk of ice formation within the cooler. To completely avoid ice formation, the control unit can place the valve apparatus in the second position as soon as the temperature of the coolant drops below 0° C. The arrangement preferably comprises temperature sensors or pressure sensors adapted to detecting a parameter which is related to the gaseous medium's pressure drop or temperature drop in the cooler. One sensor may detect the gaseous medium's pressure or temperature before it is led into the cooler and one sensor may detect the gaseous medium's pressure or temperature when it is led out from the cooler. If the pressure drop or temperature drop in the cooler is not within a predetermined value, the control unit may find that the flow passages in the cooler are about to be obstructed by ice. In such cases the control unit places the valve apparatus in the second position so that the coolant in the low-temperature cooling system is subjected to warming. The warmed coolant which flows through the cooler will melt the ice which has formed within the cooler. When the ice has melted, the control unit receives information from the sensors which indicates that the pressure drop or temperature drop in the cooler has reverted to acceptable values. The control unit returns the valve apparatus to the first position. In this case a limited amount of ice formation is thus allowed within the cooler, but the result is very effective cooling of the gaseous medium when coolant temperatures below 0° C. are acceptable so long as the cooler does not begin to freeze up.

According to another preferred embodiment of the invention, the second cooling system has a radiator element whereby the circulating coolant is cooled by air at the temperature of the surroundings. The coolant can thus be cooled to a temperature close to the temperature of the surroundings. The heat exchanger is with advantage situated in a second cooling system at a location downstream of the radiator element and upstream of the cooler with respect to the intended direction of coolant flow in the second cooling system. The coolant in the second system can thus be warmed substantially immediately before it is led into the cooler. In situations where the valve apparatus is placed in the second position, relatively warm coolant can thus be led into the cooler so that the ice which has formed within the cooler will quickly melt away.

According to another preferred embodiment of the invention, the first cooling system is adapted to cooling the combustion engine. During normal operation, the cooling system which cools a combustion engine is at a temperature of 80-100° C. This existing coolant is therefore very suitable for use for warming the coolant in the low-temperature cooling system. The cooling system which cools the combustion engine may comprise a line adapted to leading warm coolant to the heat exchanger from a location in the cooling system substantially immediately downstream of the combustion engine. When the coolant has cooled the combustion engine, it will be at its highest temperature in the cooling system and can therefore very effectively be used for optimum warming of coolant in order to warm the coolant in the low-temperature cooling system when there is ice formation.

According to another preferred embodiment of the invention, the arrangement comprises a further cooler whereby the gaseous medium is intended to be subjected to a first step of cooling by the coolant in the first cooling system before the gaseous medium is led to the aforesaid cooler, in which it undergoes a second step of cooling by the coolant in the second cooling system. The gaseous medium may be the compressed air which is led into an inlet line to the combustion engine. When air is compressed, it undergoes an amount of heating which is related to the degree of compression of the air. In supercharged combustion engines, air is used at a very high pressure. The air therefore requires effective cooling. Accordingly, it is advantageous to cool the compressed air in more than one cooler and in two or more stages so that it can reach a desired low temperature before it is led to the combustion engine. Said gaseous medium may also be recirculating exhaust gases which are led in a return line to the combustion engine. The exhaust gases may be at a temperature of 500-600° C. when they are led into the return line. It is therefore also advantageous to cool the exhaust gases in more than one cooler and in two or more stages so that they can reach a desired low temperature before they are led to the combustion engine.

BRIEF DESCRIPTION OF THE DRAWING

A preferred embodiment of the invention is described below by way of example with reference to the attached drawing, in which:

The FIGURE depicts an arrangement for a supercharged combustion engine according to an embodiment of the invention.

DETAILED DESCRIPTION OF A PREFERRED EMBODIMENT OF THE INVENTION

The FIGURE depicts an arrangement for a supercharged combustion engine which is intended to power a schematically depicted vehicle 1. The combustion engine is here exemplified as a diesel engine 2. The diesel engine 2 may be intended to power a heavy vehicle 1. The exhaust gases from the cylinders of the diesel engine 2 are led via an exhaust manifold 3 to an exhaust line 4. The diesel engine 2 is provided with a turbo unit which comprises a turbine 5 and a compressor 6. The exhaust gases in the exhaust line 4, which are at above atmospheric pressure, are led initially to the turbine 5. The turbine 5 is thus provided with driving power which is transferred, via a connection, to the compressor 6. The compressor 6 uses this power to compress air which is drawn into an air inlet line 8 via an air filter 7. The air in the inlet line is cooled initially in a first coolant-cooled charge air cooler 9. The air is cooled in the first charge air cooler 9 by coolant from the combustion engine's cooling system. The compressed air is thereafter cooled in a second coolant-cooled charge air cooler 10. The air is cooled in the second charge air cooler 10 by coolant from a separate cooling system.

The arrangement comprises a return line 11 for effecting recirculation of part of the exhaust gases in the exhaust line 4. The return line has an extent between the exhaust line 4 and the inlet line 8. The return line 11 comprises an EGR valve 12 by which the exhaust flow in the return line 11 can be shut off.

The EGR valve 12 can also be used for steplessly controlling the amount of exhaust gases which is led from the exhaust line 4 to the inlet line 8 via the return line 11. A control unit 13 is adapted to controlling the EGR valve 12 on the basis of information about the current operating state of the diesel engine 2. The return line 11 comprises a first coolant-cooled EGR cooler 14 for subjecting the exhaust gases to a first step of cooling. The exhaust gases are cooled in the first EGR cooler 14 by coolant from the combustion engine's cooling system. The exhaust gases are subjected to a second step of cooling in a coolant-cooled EGR cooler 15. The exhaust gases are cooled in the second EGR cooler 15 by coolant from the separate cooling system.

In certain operating situations in supercharged diesel engines 2, the pressure of the exhaust gases in the exhaust line 4 will be lower than the pressure of the compressed air in the inlet line 8. In such operating situations it is not possible to mix the exhaust gases in the return line 11 directly with the compressed air in the inlet line 8 without special auxiliary means. To this end it is possible to use, for example, a venturi 16 or a turbo unit with variable geometry. If instead the combustion engine 2 is a supercharged Otto engine, the exhaust gases in the return line 11 can be led directly into the inlet line 8, since the exhaust gases in the exhaust line 4 of an Otto engine in substantially all operating situations will be at a higher pressure than the compressed air in the inlet line 8. When the exhaust gases have mixed with the compressed air in the inlet line 8, the mixture is led to the respective cylinders of the diesel engine 2 via a manifold 17.

The combustion engine 2 is cooled in a conventional manner by a cooling system which contains a circulating coolant. The coolant is circulated in the cooling system by a coolant pump 18. A main flow of the coolant is circulated through the combustion engine 2. After the coolant has cooled the combustion engine 2, it is led in a line 21 to a thermostat 19 in the cooling system. When the coolant has reached a normal operating temperature, the thermostat 19 is adapted to leading it to a radiator 20 fitted at a forward portion of the vehicle, in order to be cooled. A smaller portion of the coolant in the cooling system is nevertheless not led back to the combustion engine 2 but is circulated through a line 22 which divides into two parallel lines 22*a*, 22*b*. The line 22*a* leads coolant to the first charge air cooler 9 in which it subjects the compressed air to a first step of cooling. The line 22*b* leads coolant to the first EGR cooler 14 in which it subjects the recirculating exhaust gases to a first step of cooling. The coolant which has cooled the air in the first charge air cooler 9 and the coolant which has cooled the exhaust gases in the first EGR cooler 14 are reunited in the line 22, which leads the coolant back to the line 21. The warmed coolant is led in the line 21 to the radiator 20.

The separate cooling system comprises a radiator element 24 fitted in front of the radiator 20 in a peripheral region of the vehicle 1. In this case the peripheral region is situated at a front portion of the vehicle 1. A radiator fan 25 is adapted to generating an air stream of surrounding air through the radiator element 24 and the radiator 20. As the radiator element 24 is situated in front of the radiator 20, the coolant is cooled in the radiator element 24 by air at the temperature of the surroundings. The coolant in the radiator element 24 can thus be cooled to a temperature close to the temperature of the surroundings. The cold coolant from the radiator element 24 is circulated in the separate cooling system in a line 26 by a pump 27.

A heat exchanger 28 is arranged in the line 26. If need be, the cold coolant in the separate cooling system may be warmed in the heat exchanger 28 by warm coolant from the combustion engine's cooling system. The combustion engine's cooling system comprises a line 29 which has an extent from a location 21*a* in the line 21 where it receives warm coolant which has just passed through the combustion engine. The line 29 comprises a valve 30 which can be placed in a closed position and in at least one open position by a control unit 31. When the valve 30 is in an open position, warm coolant is led through the line 29, which extends through the heat exchanger 28. The coolant is thereafter led to a line 23 which constitutes an ordinary part of the combustion engine's cooling system and which leads cooled coolant from the radiator 20 to the combustion engine 2.

After the coolant in the separate cooling system has passed through the heat exchanger 28, the line 26 divides into two parallel lines 26*a*, 26*b*. The line 26*a* leads coolant to the second charge air cooler 10 in which it subjects the compressed air to a second step of cooling. The line 26*b* leads coolant to the second EGR cooler 15 in which it subjects the recirculating exhaust gases to a second step of cooling. After the coolant has passed through the second charge air cooler 10 and the second EGR cooler 15, the lines 26*a*, 26*b* join together. The coolant is thereafter led in the line 26 to the radiator element 24 in order to be cooled. A first pressure sensor 32 is arranged in the air line 8 to detect the pressure of the air before it is led into the second charge air cooler 10. A second pressure sensor 33 is arranged in the air line 8 to detect the pressure of the air after it has passed through the second charge air cooler 10. A third pressure sensor 34 is arranged in the return line 11 to detect the pressure of the exhaust gases before they are led into the second EGR cooler 15. A fourth pressure sensor 35 is arranged in the return line 11 to detect the pressure of the exhaust gases after they have passed through the second EGR cooler 15. The control unit 31 is adapted to receiving from said sensors information concerning measured pressures.

During operation of the diesel engine 2, exhaust gases flow through the exhaust line 4 and drive the turbine 5. The turbine 5 is thus provided with driving power which drives the compressor 6. The compressor 6 draws surrounding air in via the air filter 7 and compresses the air in the inlet line 8. The air thus acquires an increased pressure and an increased temperature. The compressed air is cooled in the first charge air cooler 9 by the radiator liquid in the combustion engine's cooling system. The radiator liquid may here be at a temperature of about 80-85° C. Thus the compressed air can undergo in the first charge air cooler 9 a first step of cooling to a temperature close to the temperature of the coolant. The compressed air is thereafter led through the second charge air cooler 10, in which it is cooled by the coolant in the separate cooling system. The coolant may here be at a temperature close to the temperature of the surroundings. Thus the compressed air also can in favourable circumstances be cooled to a temperature close to the temperature of the surroundings.

In most operating states of the diesel engine 2, the control unit 13 will keep the EGR valve 12 open so that part of the exhaust gases in the exhaust line 4 is led into the return line 11. The exhaust gases in the exhaust line 4 may be at a temperature of about 500-600° C. when they reach the first EGR cooler 14. The recirculating exhaust gases undergo in the first EGR cooler 14 a first step of cooling by the coolant in the combustion engine's cooling system.

The coolant in the combustion engine's cooling system will thus be at a relatively high temperature but definitely lower than the temperature of the exhaust gases. It is thus possible to effect good cooling of the exhaust gases in the first EGR cooler 14. The recirculating exhaust gases are thereafter led to the second EGR cooler 15, in which they are cooled by the coolant in the separate cooling system. The coolant will here be at a definitely lower temperature and the exhaust gases can in favourable circumstances be cooled to a temperature close to the temperature of the surroundings. Exhaust gases in the return line 11 can thus undergo cooling to substantially the same low temperature as the compressed air before they mix and are led to the combustion engine 2. A substantially optimum amount of air and recirculating exhaust gases can therefore be led into the combustion engine. Combustion in the combustion engine with substantially optimum performance is thus made possible. The low temperature of the compressed air and the recirculating exhaust gases also results in a lower combustion temperature and hence a lower content of nitrogen oxides in the exhaust gases.

This effective cooling of the compressed air and the recirculating exhaust gases also has disadvantages. The compressed air is cooled in the second charge air cooler 10 to a temperature at which water in liquid form precipitates within the charge air cooler 10.

Similarly, the exhaust gases in the second EGR cooler 15 are cooled to a temperature at which condensate forms within the second EGR cooler 15. When the temperature of the surrounding air is lower than 0° C., there is also risk of the precipitated water freezing to ice within the second charge air cooler 10 and of the precipitated condensate freezing to ice within the second EGR cooler 15. Ice formation within the second charge air cooler 10 and the second EGR cooler 15 might seriously disturb the operation of the combustion engine 2. To prevent the second charge air cooler 10 and the second EGR cooler 15 from freezing up, the control unit 31 substantially continuously receives information from the pressure sensors 32, 33 concerning the pressure of the air before and after the second charge air cooler 10 and from the pressure sensors 34, 35 concerning the pressure of the recirculating exhaust gases before and after the second EGR cooler 15. If the pressure sensors 32, 33 indicate a pressure drop which exceeds a predetermined threshold value in the second charge air cooler 10, the control unit 31 may find that ice has formed within the charge air cooler 10. If the pressure sensors 34, 35 indicate a pressure drop which exceeds a predetermined threshold value in the second EGR cooler 15, it may similarly be found that ice has formed in the second EGR cooler 15.

If the control unit 31 receives such information, it opens the valve 30 so that warm coolant from the combustion engine's cooling system is led through the line 29 and the heat exchanger 28. The warm coolant from the combustion engine's cooling system will warm the cold coolant in the separate cooling system which continuously flows through the heat exchanger 28. The heat exchanger 28 is situated in the separate cooling system at a location downstream of the radiator element 24 and upstream of the second charge air cooler 10 and the second EGR cooler 15 with respect to the intended direction of coolant flow in the separate cooling system. The coolant in the separate system is thus provided with a marked warming substantially immediately before it is led to the second charge air cooler 10 and to the second EGR cooler 15. When the warm coolant is led through the second charge air cooler 10 and the second EGR cooler 15, it will quickly and effectively melt the ice which has formed in the coolers 10, 15.

As soon as the control unit 31 receives information which indicates that the pressure drop in the second charge air cooler 10 and in the second EGR cooler 15 has reverted to acceptable values, the control unit 31 closes the valve 30, thereby halting the circulation of warm coolant from the combustion engine's cooling system through the heat exchanger 28. The warming of the coolant in the separate cooling system ceases and cold coolant which has been cooled in the radiator element 24 can be reused for cooling the air in the second charge air cooler 10 and the exhaust gases in the EGR cooler 15. If a very low ambient temperature occurs during operation of the vehicle, the control unit 31 may at regular intervals place the valve 30 in an open position to prevent too much ice formation in the second charge air cooler 10 and in the second EGR cooler 15. The arrangement thus makes possible very effective cooling of the air in the second charge air cooler 10 and the exhaust gases in the second EGR cooler 15. At the same time, there is prevention in the second charge air cooler 10 and in the second EGR cooler 15 of ice formation which might disturb the operation of the combustion engine 2.

The invention is in no way limited to the embodiment depicted in the drawing but may be varied freely within the scopes of the claims. In the embodiment example, pressure sensors are used to determine the pressure drop across the coolers as a parameter for indicating when ice has formed in the coolers. Temperature sensors may equally well be used for determining the temperature drop in the coolers as a parameter for indicating when ice has formed in the coolers. According to another alternative, a temperature sensor may be used to detect the temperature of the coolant which is led to the coolers 10, 15. If the temperature of the coolant is over 0° C., no ice formation can occur in the coolers 10, 15. In the embodiment depicted, the arrangement is used to keep both the second charge air cooler 10 and the second EGR cooler 15 substantially free from ice. The arrangement may also be used for keeping only one of said coolers 10, 15 substantially free from ice. The arrangement is intended for a supercharged combustion engine in which a turbo unit is used for compressing the air which is led to the combustion engine. The arrangement may of course also be used for supercharged combustion engines in which the air is compressed by more than one turbo unit. In such cases the first charge air cooler 9 may be used as an intermediate cooler for cooling the air between the compressions in the compressors of the turbo units.

The invention claimed is:

1. An arrangement for controlling cooling of a gaseous medium which contains water vapour in a supercharged combustion engine, the arrangement comprising:

a first cooling system with a first circulating coolant and the first cooling system being configured for establishing a first temperature of the first coolant, a second cooling system with a second circulating coolant and the second cooling system being configured for establishing a second temperature of the second coolant, and the second coolant during normal operation of the combustion engine is at a lower temperature than the first coolant in the first cooling system;

a cooler in which a gaseous medium which contains water vapour is intended to be cooled by the coolant in the second cooling system;

a heat exchanger which comprises a first passage configured to having coolant from the first cooling system flow through it and a second passage configured to having coolant from the second cooling system flow through it, a valve which can be placed in a first position at which the valve prevents the coolant from at least one of the cooling systems from flowing through the heat exchanger and in a second position at which the valve permits the coolants from both of the cooling systems to flow through the heat exchanger so that the second coolant in the second cooling system is warmed by the first coolant in the first cooling system;

at least one sensor configured to detecting a parameter which indicates whether the gaseous medium is cooled so much that there is ice formation or risk of ice formation in the cooler; and a control unit configured to receiving information from at least one sensor and to deciding whether there is ice formation or risk of ice formation in the cooler and, if there is such formation of ice or risk of ice formation, to placing the valve in the second position.

2. An arrangement according to claim 1, wherein the at least one sensor comprises a pressure sensor or a temperature sensor configured and located to detect a parameter which is related to a pressure drop or a temperature drop in the gaseous medium in the cooler.

3. An arrangement according to claim 1, wherein the second cooling system has a radiator element located and configured such that the second circulating coolant is cooled by air at the temperature of the surroundings.

4. An arrangement according to claim 1, wherein the heat exchanger is situated at the second cooling system at a location downstream of the radiator element and upstream of the cooler in the circulation of the second coolant.

5. An arrangement according to claim 1, wherein the first cooling system is configured and located for cooling the combustion engine.

6. An arrangement according to claim 5, wherein the first cooling system comprises a line configured to leading warm first coolant to the heat exchanger from a location in the first cooling system which is situated substantially immediately downstream of the combustion engine.

7. An arrangement according to claim 1, further comprising a second cooler configured such that the gaseous medium is subjected to a first step of cooling by the first coolant in the first cooling system before the gaseous medium is led to the first mentioned cooler which subjects the gaseous medium to a second step of cooling by the second coolant in the second cooling system.

8. An arrangement according to claim 7, further comprising a line configured for transmitting the gaseous medium past the first mentioned cooler and then past the second cooler and then to the combustion engine.

9. An arrangement according to claim 1, further comprising an inlet line, wherein the gaseous medium is compressed air and the inlet line is configured to transmit the compressed air to the combustion engine.

10. An arrangement according to claim 9, further comprising a return line wherein the gaseous medium is recirculating exhaust gases from the engine and the return line is configured to transmit the recirculating exhaust gases to the combustion engine.

11. An arrangement according to claim 1, further comprising a return line wherein the gaseous medium is recirculating exhaust gases from the engine and the return line is configured to transmit the recirculating exhaust gases to the combustion engine.

12. An arrangement according to claim 1, further comprising a line configured for transmitting the gaseous medium past the cooler to be cooled and then to the combustion engine.

* * * * *